US006148956A

United States Patent [19]

Iwatsuki

[11] Patent Number: 6,148,956

[45] Date of Patent: Nov. 21, 2000

[54] RESONATOR WITH HIGH HEAT RESISTANCE

[75] Inventor: Takane Iwatsuki, Kariya, Japan

[73] Assignee: Toyoda Boshoku Corporation, Kariya, Japan

[21] Appl. No.: 09/347,524

[22] Filed: Jul. 6, 1999

[30] Foreign Application Priority Data

Jul. 9, 1998 [JP] Japan ..... 10-194592

[51] Int. Cl.[7] ..... F01N 7/18

[52] U.S. Cl. ..... 181/282; 181/224; 181/229; 181/250

[58] Field of Search ..... 181/282, 224, 181/229, 250

[56] References Cited

U.S. PATENT DOCUMENTS

| | | | |
|---|---|---|---|
| 4,546,733 | 10/1985 | Fukami et al. | 123/52 MB |
| 4,874,062 | 10/1989 | Yanagida et al. | 181/250 |
| 5,248,738 | 9/1993 | Sato et al. | 525/432 |
| 5,349,141 | 9/1994 | Horibe et al. | 181/224 |
| 5,723,828 | 3/1998 | Nakagawa | 181/250 |

FOREIGN PATENT DOCUMENTS

| | | | |
|---|---|---|---|
| 60-119312 | 6/1985 | Japan | F01N 1/02 |
| 1-253559 | 10/1989 | Japan | F02M 35/12 |
| 4-37522 | 2/1992 | Japan . | |
| 7-251628 | 10/1995 | Japan | B60H 1/00 |
| 9-88748 | 3/1997 | Japan . | |
| 11-44266 | 2/1999 | Japan | F02M 35/12 |

*Primary Examiner*—David Martin
*Assistant Examiner*—Edgardo San Martin
*Attorney, Agent, or Firm*—Oliff & Berridge, PLC

[57] ABSTRACT

The present invention provides a resonator including an upper case defining a portion of a resonance chamber and having a communicating hole communicating with the resonance chamber, a lower case integrally joined to the upper case and defining the resonance chamber together with the upper case, and an air pipe which is blow molded with the upper case being inserted, which is joined to an outer surface of the upper case where the communicating hole opens, an inside of which forms a gas passage, and which is defined with a through hole forming a common hole with the communicating hole, wherein the air pipe is blow molded by using polypropylene resin and the lower case is molded by using a nylon resin. In the resonator of the invention, because the resonator itself has heat resistance, it is unnecessary to dispose a heat insulator or the like, thereby decreasing the number of parts and the cost.

10 Claims, 6 Drawing Sheets

RESONATOR WITH HIGH HEAT RESISTANCE

The disclosure of Japanese Patent Application No. HEI 10-194592 filed on Jul. 9, 1998 including the specification, drawings and abstract is incorporated herein by reference in its entirety.

BACKGROUND OF THE INVENTION

1. Field of the Invention

The present invention relates to a resonator which is provided to an intake flow path of an automobile and reduces intake noise.

2. Description of the Related Art

A resonator utilizing Helmholtz's principle of resonance is disposed in an intake flow path of an engine or an intake flow path of an air conditioning system of an automobile so as to absorb noise generated by gas passing through the flow path. The intake noise at a specific frequency is, thus, absorbed by the resonator.

The resonator is disposed in, for example, an air pipe connecting an air cleaner and a throttle body of the automobile. The resonator has a structure in which an intake flow path of the air pipe communicates with the resonance chamber in a state in which a resonance chamber formed by positively joining an upper case and a lower case to each other is joined to an air pipe. On an air cleaner side of the air pipe, a bellows portion for absorbing vibration is provided. The air pipe is produced by using a polypropylene resin so as to ensure formability of the bellows portion and flexibility of a throttle valve inserting portion. Because air leakage is not permitted in a joint between the air pipe and the resonance chamber of the resonator, the polypropylene resin which exhibits excellent sealing capability and is the same as the material of the air pipe is used for molding the upper case. The polypropylene resin is also used for the lower case because the lower case is integrally fused to the upper case.

Because the air pipe of the automobile is for ventilating a throttle body from the air cleaner, the air pipe is normally disposed in an engine room and it is possible that the air pipe is laid to overstride an exhaust manifold in the engine room in some cases. In such cases, there is a problem concerning heat resistance of the polypropylene resin which constitutes the resonance chamber of the resonator. A maximum resistible temperature of the polypropylene resin is around 120° C. in general, and a heat insulator may be attached to the exhaust manifold or the resonator itself for heat insulation if the temperature exceeds the maximum resistible temperature.

However, in regard to the case of attaching the heat insulator to the exhaust manifold, since the countermeasure against heat of the exhaust manifold has been taken with the aid of improved performance of the engine, the heat insulator has been detached from the exhaust manifold in recent years.

In the case of attaching the heat insulator to the resonator itself, on the other hand, as the heat insulator, bolts, nuts, heat-insulating washers for attaching the heat insulator to the resonator are required, the number of required parts and the assembly man-hour are increased, leading to the cost increase.

SUMMARY OF THE INVENTION

The present invention provides a resonator with high heat resistance without attachment of a heat insulator.

In order to solve the above problem, the present inventors repeatedly studied employment of a nylon resin molded product with high heat resistance for a resonance chamber of the resonator. As a result, although the nylon resin has difficulty in being adhered to the polypropylene resin for forming the air pipe, the inventors found that such a problem could be solved by using an intermediate resin which can be joined to the polypropylene resin and the nylon resin to adhere the polypropylene resin and the nylon resin to each other.

According to a first aspect of the invention, there is provided a resonator including an upper case defining a portion of a resonance chamber and having a communicating hole communicating with the resonance chamber, a lower case integrally joined to the upper case and defining the resonance chamber together with the upper case, and an air pipe which is blow molded with the upper case being inserted, which is joined to an outer surface of the upper case where the communicating hole opens, an inside of which forms a gas passage, and which is defined with a through hole forming a common hole with the communicating hole. The air pipe is blow molded by using a polypropylene resin, the lower case is molded by using a nylon resin, and the upper case is molded by using an intermediate resin which can be joined to the polypropylene resin and the nylon resin.

According to a second aspect of the invention, there is provided a resonator comprising an upper case defining a portion of a resonance chamber and having a communicating hole communicating with the resonance chamber, a lower case integrally joined to the upper case and defining the resonance chamber together with the upper case, an air pipe which is blow molded with the upper case being inserted, which is joined to an outer surface of the upper case where the communicating hole opens, an inside of which forms a gas passage, and which is defined with a through hole forming a common hole with the communicating hole, and a ring-shaped coupling body which is disposed at a peripheral edge portion of the communicating hole in advance, joins the upper case and the air pipe to each other, and is defined at a center portion of the ring-shaped coupling body with a through hole. The air pipe is blow molded by using a polypropylene resin, the lower case and the upper case are molded by using a nylon resin, and the ring-shaped coupling body is molded by using an intermediate resin which can be joined to the polypropylene resin and the nylon resin.

In each of the resonators according to the above first and second aspects, a nylon resin molded product with high heat resistance is used for the case defining the resonance chamber of the resonator and the case forming the resonance chamber is positively joined to the air pipe. Therefore, the resonator of the invention exhibits high heat resistance while maintaining elasticity and flexibility of a polypropylene resin of the air pipe. Because the resonator itself has heat resistance, it is unnecessary to dispose a heat insulator or the like, thus decreasing a number of parts and a cost.

DETAILED DESCRIPTION OF THE PREFERRED EMBODIMENTS

Figure 1:
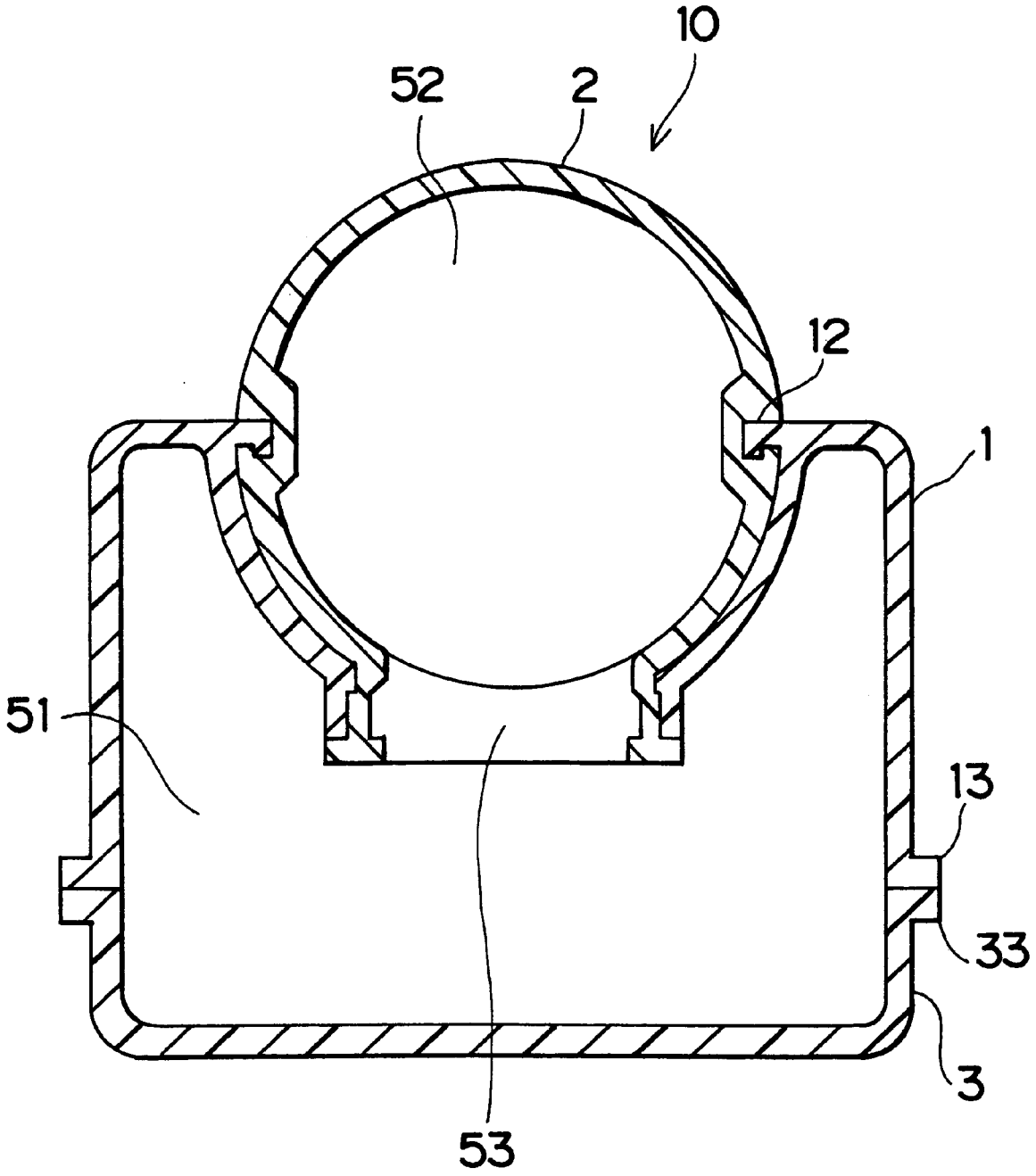
FIG. 1 is a sectional view of a resonator according to a first embodiment of the present invention.
Figure 2:
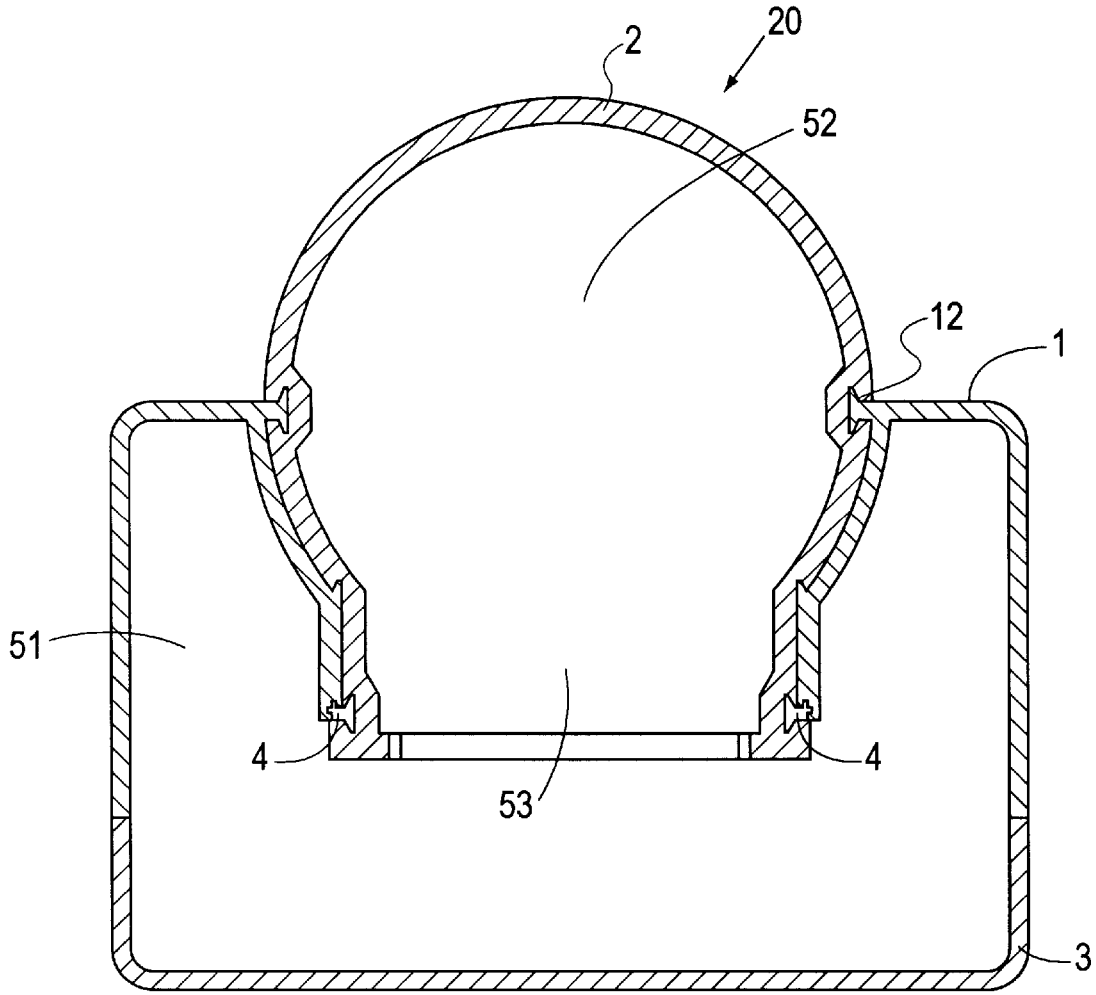
FIG. 2 is a sectional view of a portion of a resonator according to a second embodiment of the invention.

A first embodiment of the present invention will be described below referring to FIG. 1.

In a resonator 10 of the present embodiment, a lower case 3 defining a portion of a resonance chamber 51 is a nylon resin molded product with high heat resistance, an air pipe 2 constituting a gas passage 52 is a polypropylene resin molded product, the air pipe 2 and the lower case 3 are joined to each other, an upper case 1 defining a portion of the resonance chamber is made of an intermediate resin which can be joined to the polypropylene resin and the nylon resin, and a communicating hole 53 is formed in a joint between the air pipe 2 and the upper case 1.

The upper case 1 is molded by using the intermediate resin which can be joined to the polypropylene resin and the nylon resin such that the upper case 1 defines the portion of the resonance chamber 51 and has the communicating hole 53 which opens into the resonance chamber 51. The upper case 1 is molded by injection molding or the like.

The intermediate resin of the type included in the present invention has a basic structure of the following chemical formula:

[Formula 1]

The intermediate resin has a main chain of polypropylene which is nonpolar polymer and the main chain has a side chain of a polar carboxyl. A joined state of the intermediate resin to nylon and polypropylene of the type included in the present invention has the following chemical formula:

[Formula 2]

In other words, a hydrogen bond is formed between the polar functional group and a —NH— group of nylon to join the intermediate resin to nylon. With regard to joining of the intermediate resin to polypropylene, because polypropylene forming the main chain of the intermediate resin is the same type of the resin as the polypropylene resin, the polypropylene has great compatibility and fuses with the polypropylene resin.

It is preferable that the intermediate resin has a polyolefin main chain having a side chain of a polar functional group. As the polyolefin main chain, polyolefin such as polyethylene and polypropylene is preferable. As the functional group of the side chain, a carbonyl, a carboxyl, and the like are preferable. As the specific intermediate resin, for example, the resin commercially available as polyolefin highly adhesive resin can be used. The polyolefin highly adhesive resin has polyolefin such as polyethylene and polypropylene which are nonpolar polymer and to which the polar functional group such as the polar carboxyl is added. Because polyolefin as a base material of the resin has great compatibility with the polypropylene resin, the resin can be joined to the polypropylene resin. Furthermore, the intermediate resin is joined to nylon by formation of the hydrogen bond between the polar functional group and nylon.

The lower case 3 is molded by using the nylon resin such that the lower case 3 is integrally joined to the upper case 1 and defines the resonance chamber 51 together with the upper case 1. The nylon resin has a high melting point of about 220° C. and has high heat resistance. As the specific nylon resin, nylon 6 having a melting point of 220° C. or nylon 66 having a melting point of 260° C. can be used. The lower case 3 of the embodiment is made of the nylon 6 including 30% by weight of glass fiber. The nylon resin molded product forming the lower case can be molded by injection molding.

The air pipe 2 is blow molded by using the polypropylene resin with the upper case 1 being inserted such that the air pipe 2 is joined to an outer surface of the upper case 1 where the communicating hole 53 opens, an inside of the air pipe 2 forms the gas passage 52, and the air pipe 2 is defined with a through hole which forms a common hole with the communicating hole 53. For the air pipe 2, a mixture formed by mixing a proper amount of glass fiber into the polypropylene resin may be used.

The air pipe 2 and the upper case 1 are fused together in the heat generated by blow molding the polypropylene resin with an upper case molded product which has been molded in advance. In this fusion, the air pipe 2 and the upper case 1 are fused together with their entire joint faces. In the blow molding, the through hole as the common hole with the communicating hole 53 of the upper case 1 is formed.

The upper case 1 and the lower case 3 are joined to each other after joining the air pipe 2 to the upper case 1. It is preferable that the upper case 1 is joined to the lower case 3 by vibration fusion.

The air pipe 2 preferably has a bellows portion. If the air pipe 2 has the bellows portion, vibration from a vehicle can be reduced when the resonator 10 is actually disposed in the vehicle.

The upper case 1 is preferably defined at its surface portion joined to the air pipe 2 with a projecting portion 12 which is buried in a wall portion constituting the air pipe 2. Because the projecting portion 12 provided to the surface of the upper case 1 is buried in the air pipe 2, it is possible to prevent displacement of the air pipe 2 from the upper case 1 and separation of the joint.

The second embodiment of the invention will be described below referring to FIGS. 2 to 6. In the following descriptions, like reference numbers are assigned to structures similar to those in the above-described first embodiment and descriptions of the structures are omitted.

In a resonator 20 of the embodiment, an upper case 1 and a lower case 3 which define a resonance chamber is the nylon resin molded products with high heat resistance, an air pipe 2 is a polypropylene resin molded product, the upper case 1 and the air pipe 2 are joined to each other through a ring-shaped coupling body 4 molded by using an intermediate resin which can be joined to both the polypropylene resin and the nylon resin, and a through hole which forms a common hole with the communicating hole 53 is formed inside a ring of the ring-shaped coupling body 4.

The upper case 1 is molded by using the nylon resin such that the upper case 1 defines a portion of the resonance chamber 51 and has the communicating hole 53 which opens into the resonance chamber 51. The lower case 3 is molded by using the nylon resin such that the lower case 3 is integrally joined to the upper case 1 and defines the resonance chamber 51 together with the upper case 1. The nylon resin has a high melting point of about 220° C. and has high heat resistance. As the specific nylon resin, nylon 6 having a melting point of 220° C. or nylon 66 having a melting point of 260° C. can be used. The upper case 1 and the lower case 3 of the embodiment are made of nylon 6 including 30% by weight of glass fiber. The nylon resin molded products forming the upper case 1 and the lower case 3 can be molded by injection molding.

The upper case 1 and the lower case 3 are joined to each other after joining the air pipe 2 to the upper case 1.

The air pipe 2 is blow molded by using polypropylene resin and joined to the upper case 1 through the ring-shaped coupling body 4. The air pipe 2 is defined with a through hole which passes through an inside of the ring of the ring-shaped coupling body 4 and which forms a common hole with the communicating hole 53. For the air pipe 2, the mixture formed by mixing a proper amount of glass fiber into the polypropylene resin may be used.

The ring-shaped coupling body 4 is disposed in advance such that the communicating hole 53 of the upper case 1 opens and the air pipe 2 is blow molded to join the air pipe 2 to the upper case 1. At this time, the through hole passes through the center portion of the ring of the ring-shaped coupling body 4 and allows the resonance chamber 51 and a gas passage 52 to communicate with each other. Because the air pipe 2 and the upper case 1 are joined to each other by the ring-shaped coupling body 4, the air pipe 2 and the upper case 1 are merely in contact with each other and are not joined to each other at portions of the air pipe 2 and the upper case 1 where the ring-shaped coupling body 4 is not disposed. The ring-shaped coupling body 4 is preferably molded by injection molding.

It is preferable that the intermediate resin has a polyolefin main chain having a side chain of a polar functional group. As the polyolefin main chain, polyolefin such as polyethylene and polypropylene is preferable. As the functional group of the side chain, a carbonyl, a carboxyl, and the like are preferable. As the specific intermediate resin, for example, the resin commercially available as the polyolefin highly adhesive resin can be used. The polyolefin highly adhesive resin has polyolefin such as polyethylene and polypropylene which are nonpolar polymers and to which the polar functional group such as the polar carboxyl is added. Because polyolefin as a base material of the resin has great compatibility with the polypropylene resin, the resin is joined to the polypropylene resin. Furthermore, the intermediate resin is joined to nylon by formation of a hydrogen bond between the polar functional group and nylon.

The ring-shaped coupling body 4 is preferably joined integrally to a peripheral edge portion of the communicating hole 53 of the upper case 1. In this joining, an end face of the ring-shaped coupling body 4 and an end face of the communicating hole 53 are joined to each other. This joining is preferably carried out by integral molding such as a method for inserting the ring-shaped coupling body 4 in a mold of the upper case 1 to integrally injection mold the upper case 1 and a method for two-color molding the ring-shaped coupling body 4 and the upper case 1 by a technique of time lag or inversion mold.

It is preferable that contact areas of the end faces of the ring-shaped coupling body 4 and the upper case 1 are large so as to increase adhesion of the ring-shaped coupling body 4 to the peripheral edge portion of the communicating hole 53 which opens in the upper case 1. In order to increase the contact areas of the end faces, it is possible to use a method of forming L-shaped steps on contact faces of the upper case 1 and the ring-shaped coupling body 4 to engage the L-shaped steps with each other as shown in a sectional view of FIG. 4, a method of forming the end face of the ring-shaped coupling body 4 into a shape of an acute triangle and forming the end face of the communicating hole 53 of the upper case 1 such that the end face pinches a tip end of the acute triangle as shown in a sectional view of FIG. 5, a method of forming a clinch structure by forming projections and depressions on the contact faces of the upper case 1 and the ring-shaped coupling body 4 as shown in a sectional view of FIG. 6, or the like.

Figure 3:
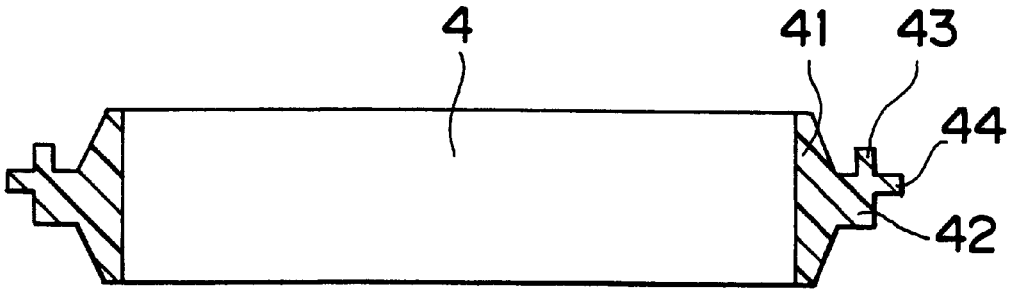
FIG. 3 is a view for showing a shape of a ring-shaped coupling body.
Figure 4:
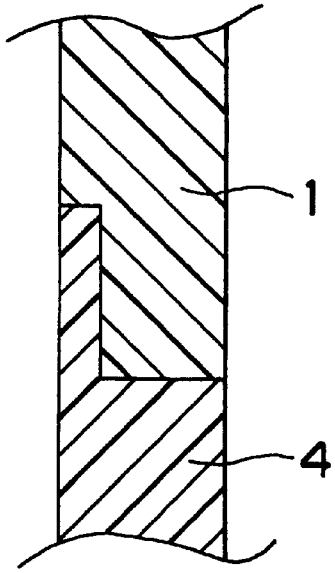
FIG. 4 is an example of a section of a joint between an upper case and a ring-shaped coupling body.
Figure 5:
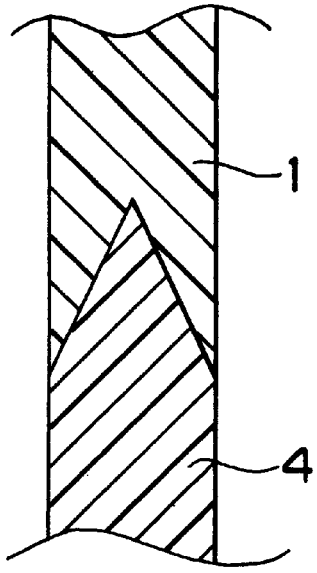
FIG. 5 is another example of the section of the joint between the upper case and the ring-shaped coupling body.
Figure 6:
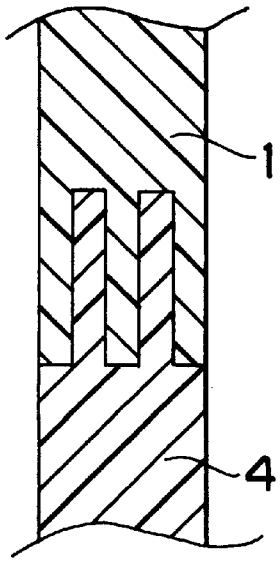
FIG. 6 is yet another example of a section of the joint between the upper case and the ring-shaped coupling body.

As shown in a sectional view of FIG. 3, the ring-shaped coupling body 4 may have an inner periphery portion 41 which is joined to the air pipe and is formed to be large and an outer periphery portion 42 which is joined to the upper case and is defined with projections 43 and 44 respectively projecting upward (toward an air pipe side) from a section of the ring and outward from the ring. The ring-shaped coupling body 4 is connected to the upper case 1 and the air pipe 2 as shown in the sectional view of FIG. 2. In other words, the ring-shaped coupling body 4 is joined to the upper case 1 such that the projections 43 and 44 of the outer periphery portion 42 are sandwiched by the upper case 1 and is joined to the air pipe 2 such that the inner periphery portion 41 is buried in the air pipe 2.

The ring-shaped coupling body 4 is preferably disposed concentrically with the communicating hole 53 and outside the communicating hole 53. By the ring-shaped body 4, the air pipe 2 and the upper case 1 are joined to each other and air leakage from the through hole which forms the common hole with the communicating hole 53 can be prevented.

The air pipe 2 preferably has a bellows portion. If the air pipe 2 has the bellows portion, vibration from a vehicle can be reduced when the resonator 20 is actually disposed in the vehicle.

The upper case 1 is preferably defined at its surface portion joined to the air pipe 2 with a projecting portion 12 which is buried in a wall portion constituting the air pipe 2. Because the projecting portion 12 provided to the surface of the upper case 1 is buried in the air pipe 2, it is possible to prevent displacement of the air pipe 2 from the upper case 1 and separation of the joint.

(Producing process)

An example of the process for producing the resonator of the present invention will be described below with reference to FIGS. 7 and 8.

Figure 7:
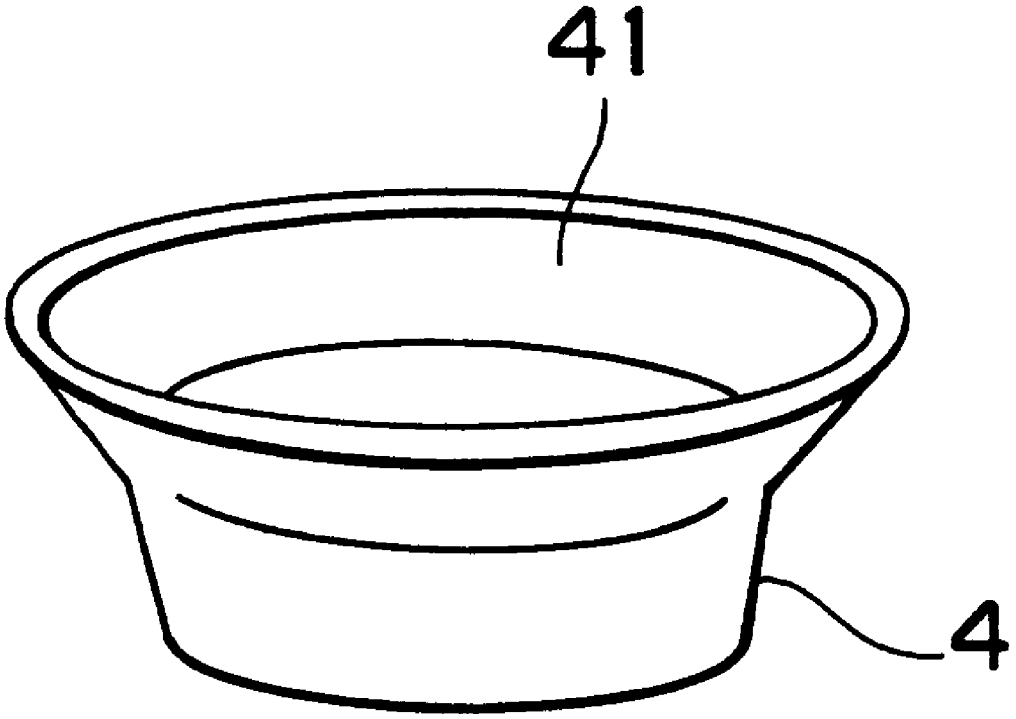
FIG. 7 is a perspective view of a pipe-shaped coupling body used in the resonator of the invention.
Figure 8:
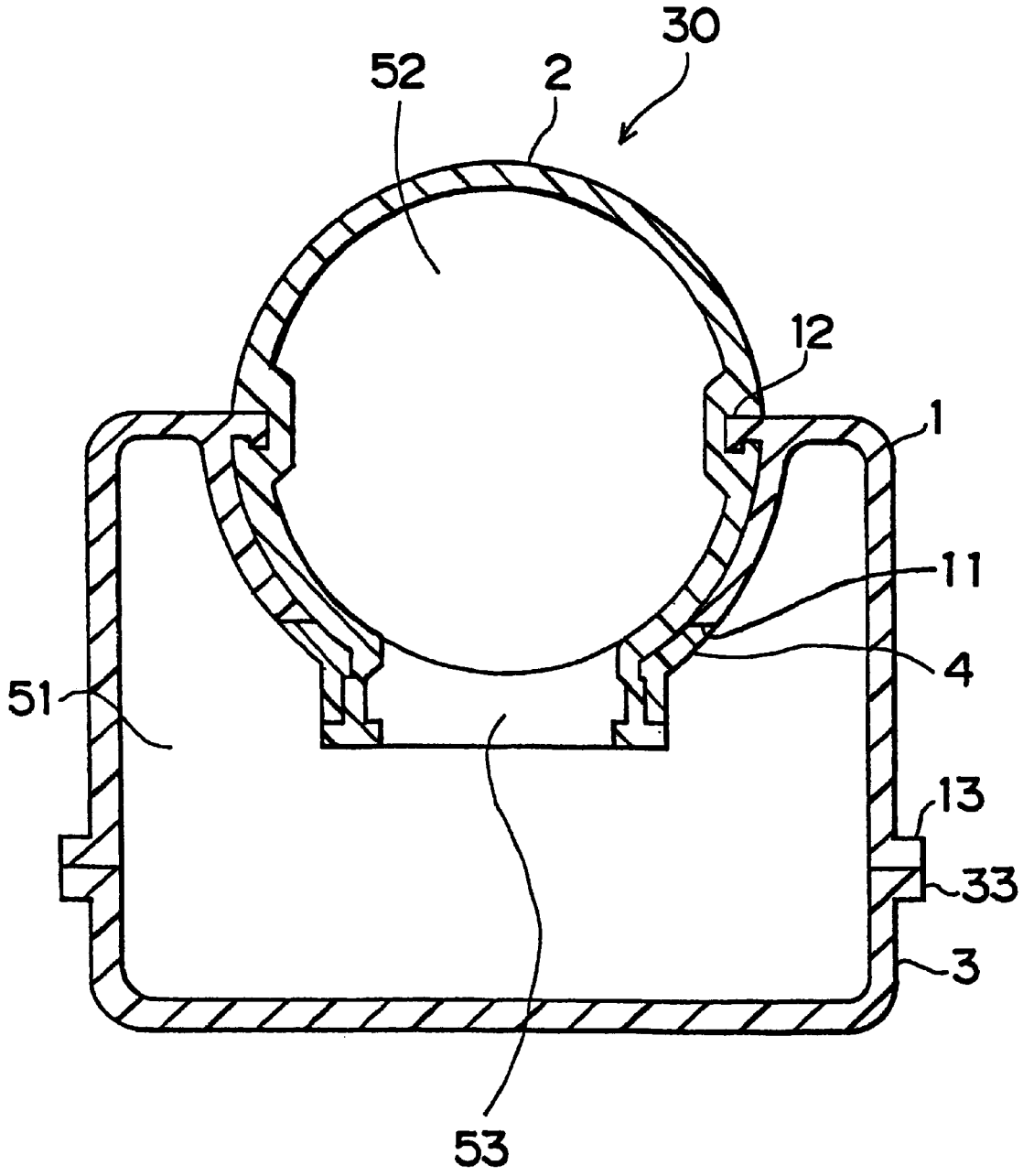
FIG. 8 is a sectional view of a joint when the pipe-shaped coupling body in FIG. 7 is joined to the upper case and the air pipe.

A pipe-shaped coupling body 4 was molded by injection molding into a cylindrical shape in which an opening portion 41 on one end side had a larger diameter as shown in FIG. 7. In a state in which the pipe-shaped coupling body 4 was inserted in the mold of the upper case 1, the upper case 1 was molded by injection molding to obtain the upper case 1 to which the pipe-shaped coupling body 4 was integrally joined. In the upper case 1, a peripheral edge portion of a communicating hole 11 and the one end portion 41 of the pipe-shaped coupling body 4 were integrally joined to each other and an inside of a pipe of the pipe-shaped coupling body 4 formed the hollow through hole 53.

In a state in which the molded upper case 1 was set in a blow mold, the air pipe 2 was blow molded to obtain the air pipe 2 to which the upper case 1 was joined. In a joint between the air pipe 2 and the upper case 1, the through hole 53 which passed through a central axis portion of the pipe-shaped coupling body 4 and connected the gas passage 52 in the air pipe 2 and the resonance chamber 51 to each other passed. The air pipe 2 and the upper case 1 were joined to each other by fusion of an inner face of the pipe of the pipe-shaped coupling body 4 and a through hole portion of the air pipe 2 with each other by heat in the blow molding and the air pipe 2 and the upper case 1 were not directly joined to each other because the air pipe 2 and the upper case 1 were made of different kinds of resin.

The obtained upper case 1 joined to the air pipe 2 was fused with and joined to the lower case 3 to obtain the resonator 30. The fusion was carried out by vibration fusion. The upper case 1 and the lower case 3 were respectively defined with flanges 13 and 33 for fusion in advance and the flanges 13 and 33 were fused with each other.

What is claimed is:

1. A resonator comprising:

an upper case defining a portion of a resonance chamber and having a communicating hole communicating with said resonance chamber;

a lower case integrally joined to said upper case and defining said resonance chamber together with said upper case; and an air pipe which is blow molded with said upper case being inserted, which is joined to an outer surface of said upper case where said communicating hole opens, an inside of which forms a gas passage, and which is defined with a through hole forming a common hole with said communicating hole, wherein said air pipe is blow molded by using a polypropylene resin, said lower case is molded by using a nylon resin, and said upper case is molded by using an intermediate resin which can be joined to said polypropylene resin and said nylon resin.

2. A resonator according to claim 1, wherein said intermediate resin has a polyolefin main chain having a side chain of a polar functional group.

3. A resonator according to claim 1, wherein said air pipe has a bellows portion.

4. A resonator according to claim 1, wherein said upper case is defined on a surface portion thereof with a projecting portion which is buried in a wall portion forming said air pipe, said surface portion being joined to said air pipe.

5. A resonator comprising:

an upper case defining a portion of a resonance chamber and having a communicating hole communicating with said resonance chamber;

a lower case integrally joined to said upper case and defining said resonance chamber together with said upper case;

an air pipe which is blowmolded with said upper case being inserted, which is joined to an outer surface of said upper case where said communicating hole opens, an inside of which forms a gas passage, and which is defined with a through hole forming a common hole with said communicating hole, and a ring-shaped coupling body which is disposed at a peripheral edge portion of said communicating hole in advance, joins said upper case and said air pipe to each other, and is defined at a center portion of said ring-shaped coupling body with a through hole, wherein said air pipe is blow molded by using a polypropylene resin, said lower case and said upper case are molded by using a nylon resin, and said ring-shaped coupling body is molded by using an intermediate resin which can be joined to said polypropylene resin and said nylon resin.

6. A resonator according to claim 5, wherein said ring-shaped coupling body is integrally joined to said peripheral edge portion of said communicating hole and forms said peripheral edge portion of said communicating hole.

7. A resonator according to claim 5, wherein said ring-shaped coupling body is disposed concentrically with said communicating hole and outside said communicating hole.

8. A resonator according to claim 5, wherein said intermediate resin has a polyolefin main chain having a side chain of a polar functional group.

9. A resonator according to claim 5, wherein said air pipe has a bellows portion.

10. A resonator according to claim 5, wherein said upper case is defined on a surface portion thereof with a projecting portion which is buried in a wall portion forming said air pipe, said surface portion being joined to said air pipe.

* * * * *